US012686580B2

(12) United States Patent
Nelson et al.

(10) Patent No.: US 12,686,580 B2
(45) Date of Patent: Jul. 21, 2026

(54) IN-LINE PACKING MATERIAL DISPENSER

(71) Applicant: Encore Packaging LLC, Lake Villa, IL (US)

(72) Inventors: Stephenson Nelson, Gurnee, IL (US); Timothy H. Nelson, Winnetka, IL (US)

(73) Assignee: ENCORE PACKAGING LLC, Lake Villa, IL (US)

( * ) Notice: Subject to any disclaimer, the term of this patent is extended or adjusted under 35 U.S.C. 154(b) by 105 days.

(21) Appl. No.: 18/581,780

(22) Filed: Feb. 20, 2024

(65) Prior Publication Data

US 2024/0417200 A1 Dec. 19, 2024

Related U.S. Application Data

(60) Provisional application No. 63/508,595, filed on Jun. 16, 2023.

(51) Int. Cl.

| | |
|---|---|
| ***B65H 16/00*** | (2006.01) |
| ***B65H 16/02*** | (2006.01) |
| ***B65H 16/08*** | (2006.01) |

(52) U.S. Cl.

CPC ..... *B65H 16/005* (2013.01); *B65H 16/021* (2013.01); *B65H 16/08* (2013.01); *B65H 2402/443* (2013.01); *B65H 2701/1944* (2013.01)

(58) Field of Classification Search

None

See application file for complete search history.

(56) References Cited

U.S. PATENT DOCUMENTS

| | | | | |
|---|---|---|---|---|
| 2,017,176 | A † | 10/1935 | Andrews | |
| 3,105,622 | A | 10/1963 | Waltz | |
| D197,623 | S | 3/1964 | Fulton | |
| 3,222,972 | A | 12/1965 | Fulton | |
| 3,236,427 | A | 2/1966 | Martin | |
| 3,813,849 | A | 6/1974 | Stambera | |
| 4,246,817 | A | 1/1981 | Marsh | |
| 5,219,126 | A * | 6/1993 | Schutz | A47K 10/3818 206/390 |
| D337,464 | S | 7/1993 | Giugiaro | |
| 6,145,782 | A | 11/2000 | King | |
| 6,199,788 | B1 | 3/2001 | Simhaee | |
| 6,328,252 | B1 | 12/2001 | Neveu | |

(Continued)

OTHER PUBLICATIONS

Email exchange between the Applicant and a Third Party dated Jun. 16, 2023.

(Continued)

*Primary Examiner* — William A. Rivera

(74) *Attorney, Agent, or Firm* — FITCH EVEN TABIN & FLANNERY, LLP

(57) ABSTRACT

A paper dispenser including a face plate with a spout having a conical shape, a first side wall and a second side wall connected to the face plate, a chute connecting the first side wall to the second side wall, the chute, the first side wall, and the second side wall including a decline towards the spout and the face plate is provided. The paper dispenser allows for multiple rolls of packing material to be placed inside and interconnected such that multiple rolls can be used in the dispenser before more rolls of packing material are needed.

10 Claims, 17 Drawing Sheets

(56) References Cited

U.S. PATENT DOCUMENTS

| | | | | |
|---|---|---|---|---|
| 8,641,591 | B2 * | 2/2014 | Wetsch | B31D 5/0052 493/464 |
| 9,894,994 | B2 * | 2/2018 | Raid | A47B 88/493 |
| 9,937,682 | B2 * | 4/2018 | Schmid | B31D 5/0039 |
| D836,954 | S | 1/2019 | Turner | |
| 10,364,112 | B2 * | 7/2019 | Giesen | B65H 16/005 |
| 10,696,002 | B2 † | 6/2020 | Mulvey | |
| 11,225,043 | B2 * | 1/2022 | Schalk | B65B 41/12 |
| D1,011,072 | S | 1/2024 | Sklenar | |
| 12,060,180 | B2 † | 8/2024 | Goodrich | |
| D1,075,345 | S | 5/2025 | Stam | |
| D1,075,346 | S | 5/2025 | Guo | |
| 2008/0125300 | A1 † | 5/2008 | Cheich | |
| 2009/0026306 | A1 * | 1/2009 | Kempster | B65H 20/26 242/593 |
| 2010/0314485 | A1 † | 12/2010 | Anderson | |
| 2011/0041461 | A1 | 2/2011 | Nelson | |
| 2013/0175311 | A1 | 7/2013 | Soucek | |
| 2014/0274647 | A1 * | 9/2014 | Wetsch | B31D 5/0043 493/464 |
| 2015/0048135 | A1 | 2/2015 | Bredahl | |
| 2015/0216377 | A1 | 8/2015 | Larsson | |
| 2017/0305652 | A1 * | 10/2017 | Giesen | B65D 85/671 |
| 2020/0147918 | A1 * | 5/2020 | Schalk | B65H 19/12 |
| 2020/0282687 | A1 | 9/2020 | Schalk | |
| 2021/0245908 | A1 * | 8/2021 | Goodrich | B65D 83/00 |
| 2024/0351818 | A1 | 10/2024 | Berdan | |

OTHER PUBLICATIONS

Email exchange between the Applicant and a Third Party dated Mar. 16, 2023, titled "Paper Dispenser Designs".

Email exchange between the Applicant and a Third Party dated Apr. 10, 2023.

Email exchange between the Applicant and a Third Party dated Apr. 25, 2023.

Email exchange between the Applicant and a Third Party dated Mar. 30, 2023, titled "Re_Telescoping Designs".

Email exchange between the Applicant and a Third Party dated Apr. 27, 2023.

Text Messages between inventor Tim Nelson (messages on the right hand side of the page, white text on a background) and a Third Party, Phil Reid, (messages on the left side of the page, black text) dating between Feb. 3, 2023, to Mar. 2, 2023 (Partially Redacted); p. 547 to 602.

Text Messages between inventor Tim Nelson (messages on the right hand side of the page, white text on a background) and a Third Party, Phil Reid, (messages on the left side of the page, black text) dating between Mar. 2, 2023, to Apr. 5, 2023 (Partially Redacted); p. 603 to 640.

Text Messages between inventor Tim Nelson (messages on the right hand side of the page, white text on a background) and a Third Party, Phil Reid, (messages on the left side of the page, black text) dating between Apr. 5, 2023, to, May 4, 2023 (Partially Redacted); p. 641 to 668.

Text Messages between inventor Tim Nelson (messages on the right hand side of the page, white text on a background) and a Third Party, Phil Reid, (messages on the left side of the page, black text) dating between May 3, 2023, to, Jun. 5, 2023 (Partially Redacted); p. 669 to 677.

Text Messages between inventor Tim Nelson (messages on the right hand side of the page, white text on a background) and a Third Party, Phil Reid, (messages on the left side of the page, black text) dating between Jun. 5, 2023, to, Jun. 19, 2023 (Partially Redacted); p. 678 to 710.

U.S. Appl. No. 63/508,595, filed Jun. 16, 2023, entitled "In-Line Packing Material Dispenser"; 29 pages.

Email exchange between a Third Party and the Applicant dated Mar. 16, 2023.

Email exchange between a Third Party and the Applicant dated Mar. 22, 2023.

Email exchange between the Applicant and a Third Party dated Mar. 30, 2023, titled "Telescoping Designs".

Email exchange between the Applicant and a Third Party dated Apr. 24, 2023.

Benchmark Industrial; "HoneyPack BuzzPro4 Paper Dispenser w/Adjustable Length, Shelf Mounted", website at https://www.benchmarkinc.com/honeypack-buzz-pro-3-afe-station-adjustable-length-bm3000.html, Gahanna, Ohio, 1 page. Available at least as early as Jan. 18, 2024.

Honeypack; "Paper Dunnage Systems", website at https://honeypack.com/paper-dunnage-systems/, Gahanna, Ohio, 1 page. Available at least as early as Jan. 18, 2024.

PaperSpace Coreless e+ web page; https://www.itape.com/product/paperspace-coreless-e/; First Accessed Apr. 3, 2025; 1 page.

ShorrExpress Paper Void Fill Systems web page, https://www.shorr.com/packaging-products/protective-packaging-products/shorrexpress-paper-void-fill-systems/, First Accessed Apr. 3, 2025; 2 pages.

3rd Party submission filed in U.S. Appl. No. 18/581,715 mailed Mar. 28, 2025; 53 pages.

3rd Party submission filed in U.S. Appl. No. 18/581,780 mailed Apr. 9, 2025; 24 pages.

USPTO; U.S. Appl. No. 29/928,106; Office Action mailed Jun. 18, 2025; 7 pages.

Shorr Packaging Corp., ShorrExpress® Paper Void Fill Systems, Pregis ShorrExpress EasyPack® Tablemate, 2025, retrieved on Apr. 3, 2025, via https://www.shorr.com/packaging-products/protective-packaging-products/shorrexpress-paper-void-fill-systems/, 2 pages.†

IPG, Paperspace Coreless e+, 2025, retrieved on Apr. 3, 2025, via https://www.itape.com/product/paperspace-coreless-e/, 4 pages.†

* cited by examiner
† cited by third party

IN-LINE PACKING MATERIAL DISPENSER

CROSS-REFERENCE TO RELATED APPLICATION

This application claims the benefit of priority to U.S. Provisional Application No. 63/508,595, filed Jun. 16, 2023, entitled In-Line Packing Material Dispenser, the content of which is incorporated by reference in its entirety herein.

TECHNICAL FIELD

This disclosure relates generally to an in-line packing material dispenser, and more specifically, to a packing material dispenser utilizing interconnected rolls of packing material.

BACKGROUND

The packing industry uses a variety of materials to secure items for shipping. Packing material dispensers aid in storing packing materials, such as rolls of kraft paper, for ease of access and ease of use for a user packing a package. Such material dispensers, however, are typically limited in the number of rolls of material that can be held such that a user may be interrupted during a packing operation by running out of material.

BRIEF DESCRIPTION OF THE DRAWINGS

Disclosed herein are embodiments of apparatuses pertaining to packing material dispensers including and/or utilizing an in-line configuration and interconnected rolls of packing material. This description includes drawings, wherein.

Figure 1:
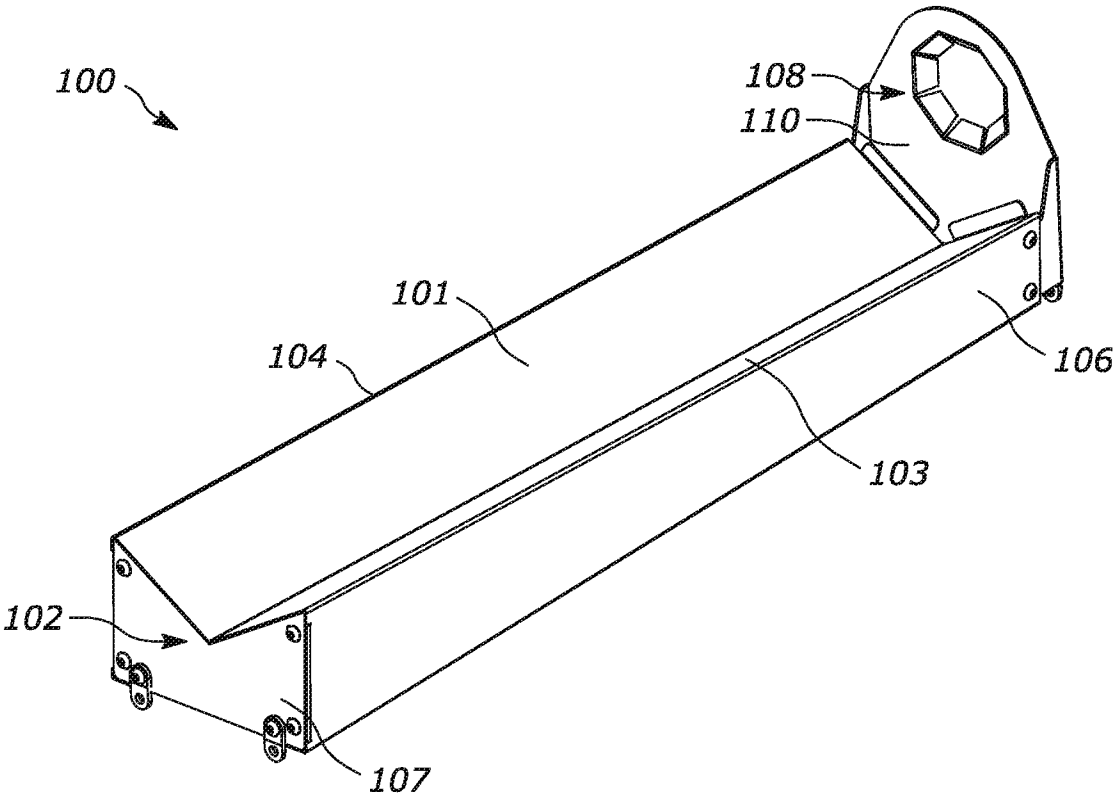
FIG. 1 is a rear perspective view of a packaging material holder in accordance with various embodiments.
Figure 2:
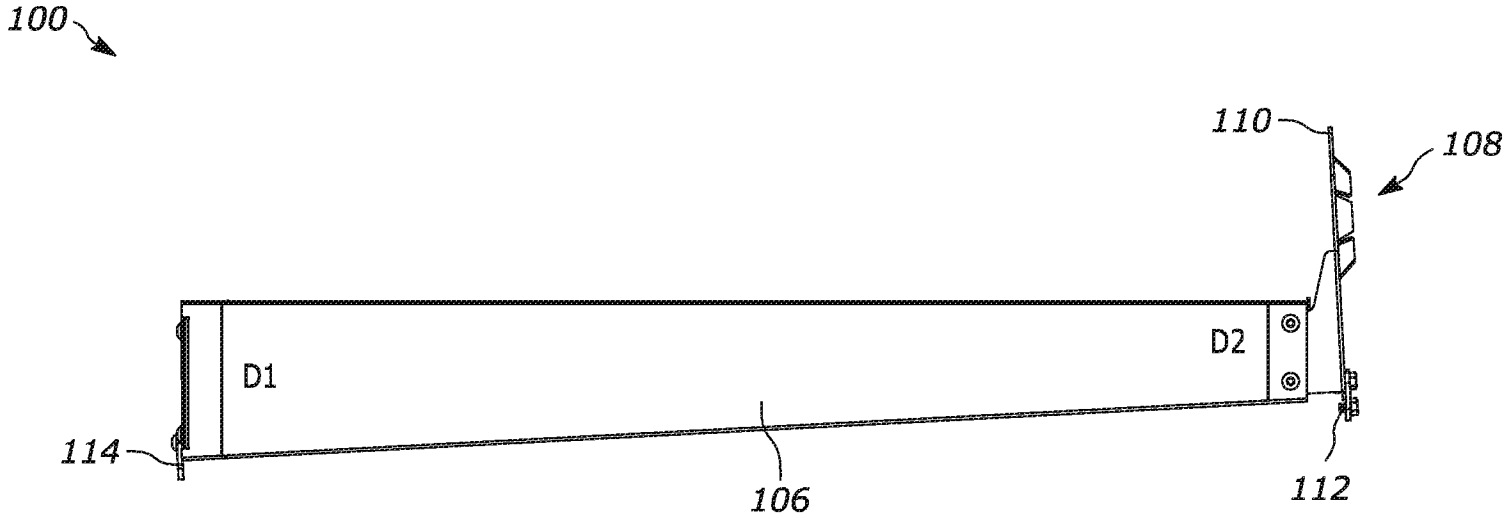
FIG. 2 is a side view of a packing material dispenser in accordance with various embodiments.
Figure 3:
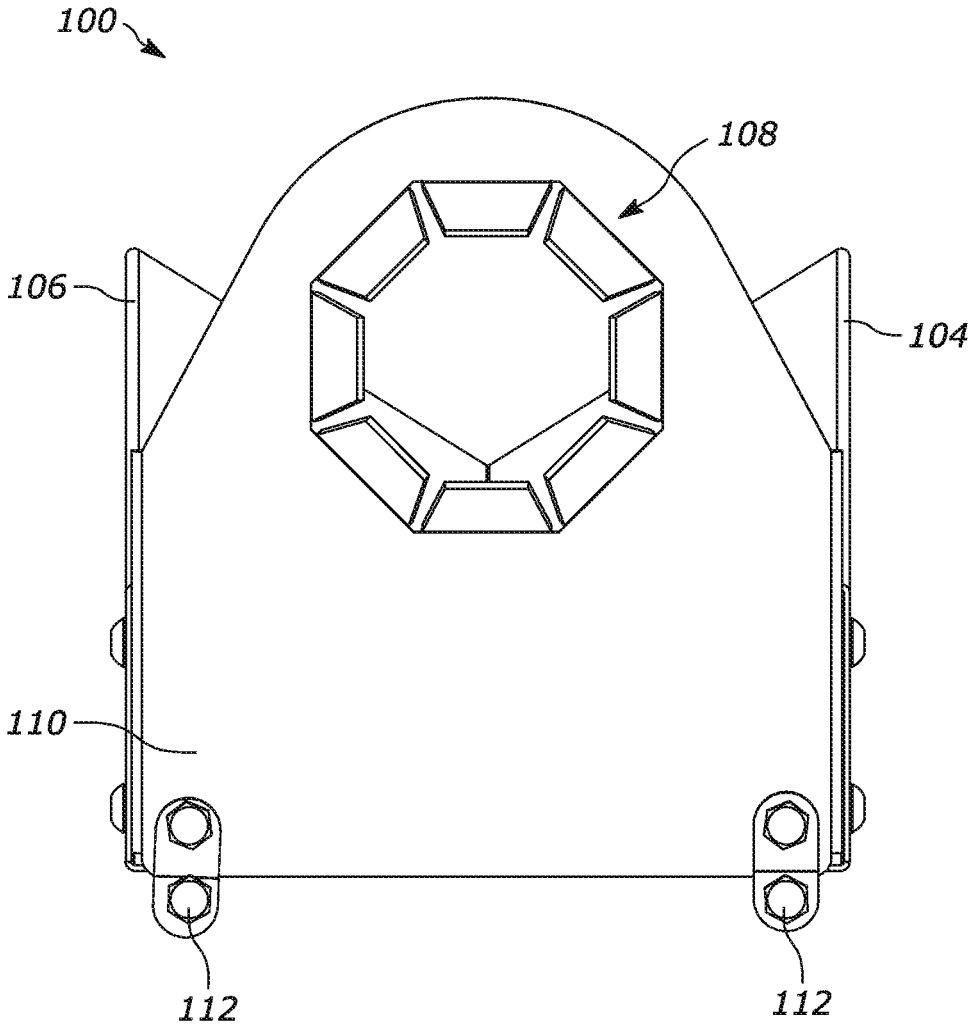
FIG. 3 is a front view of a packing material dispenser in accordance with various embodiments.
Figure 4:
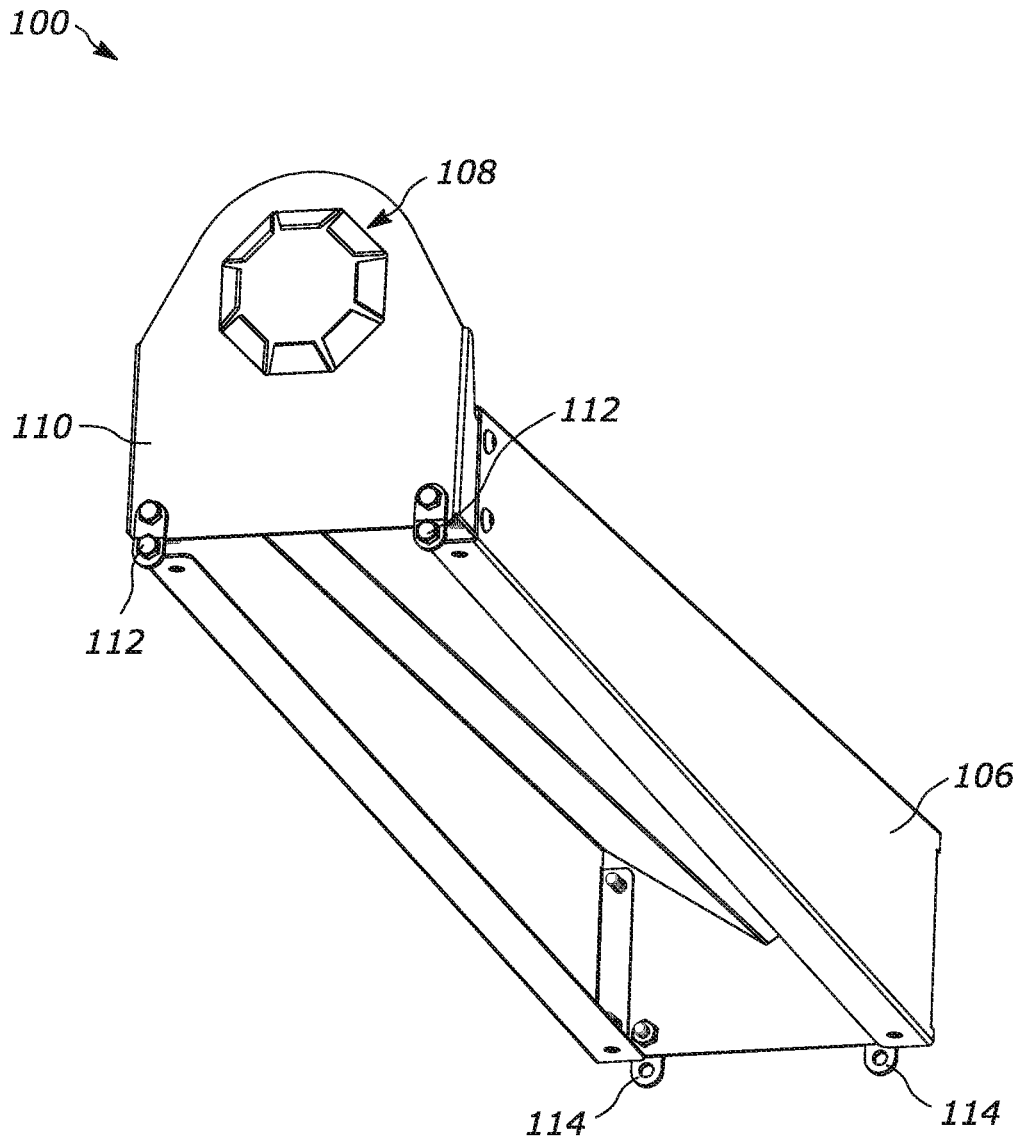
FIG. 4 is a bottom perspective view of a packing material dispenser in accordance with various embodiments.
Figure 5:
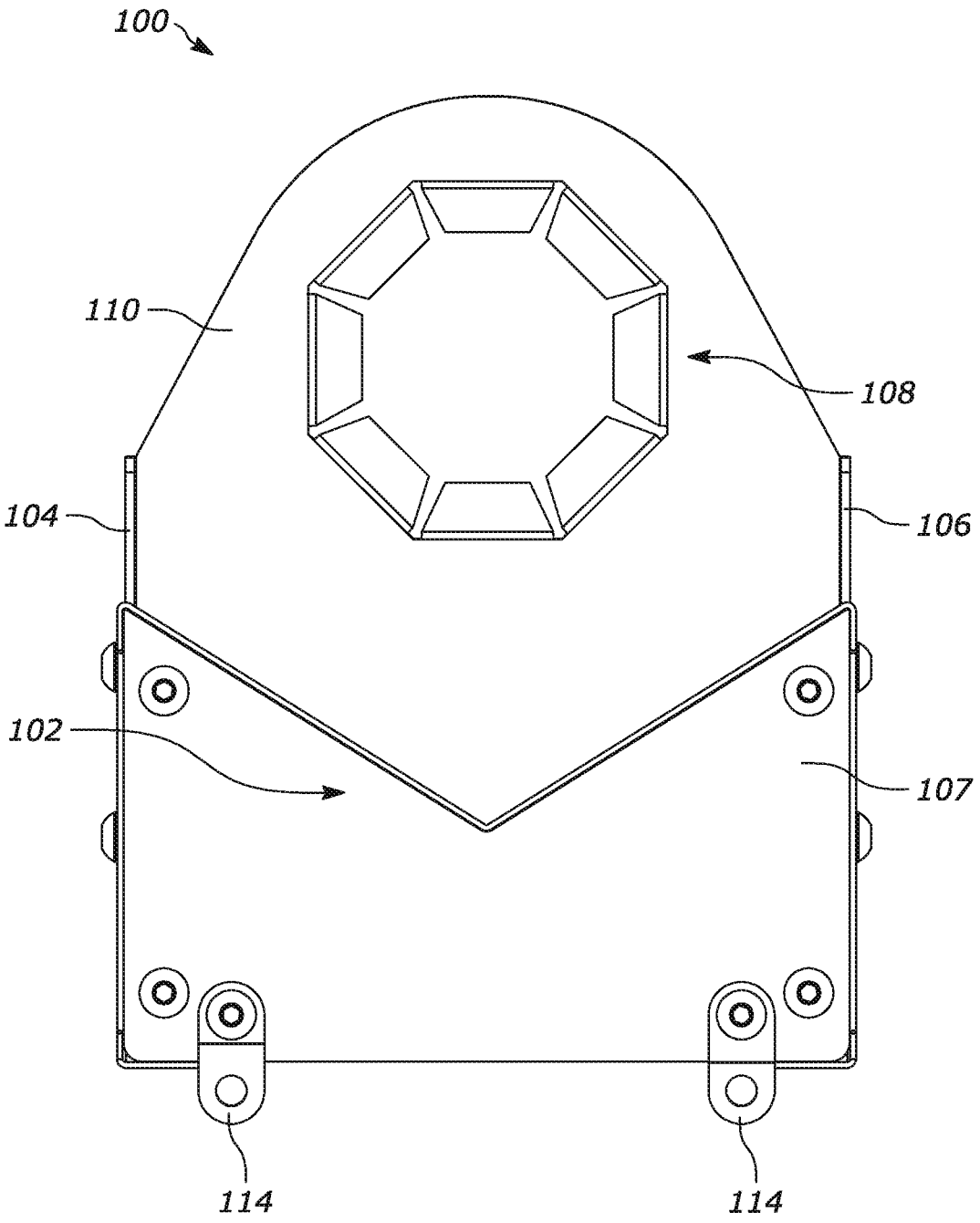
FIG. 5 is a rear view of a packing material dispenser in accordance with various embodiments.
Figure 6:
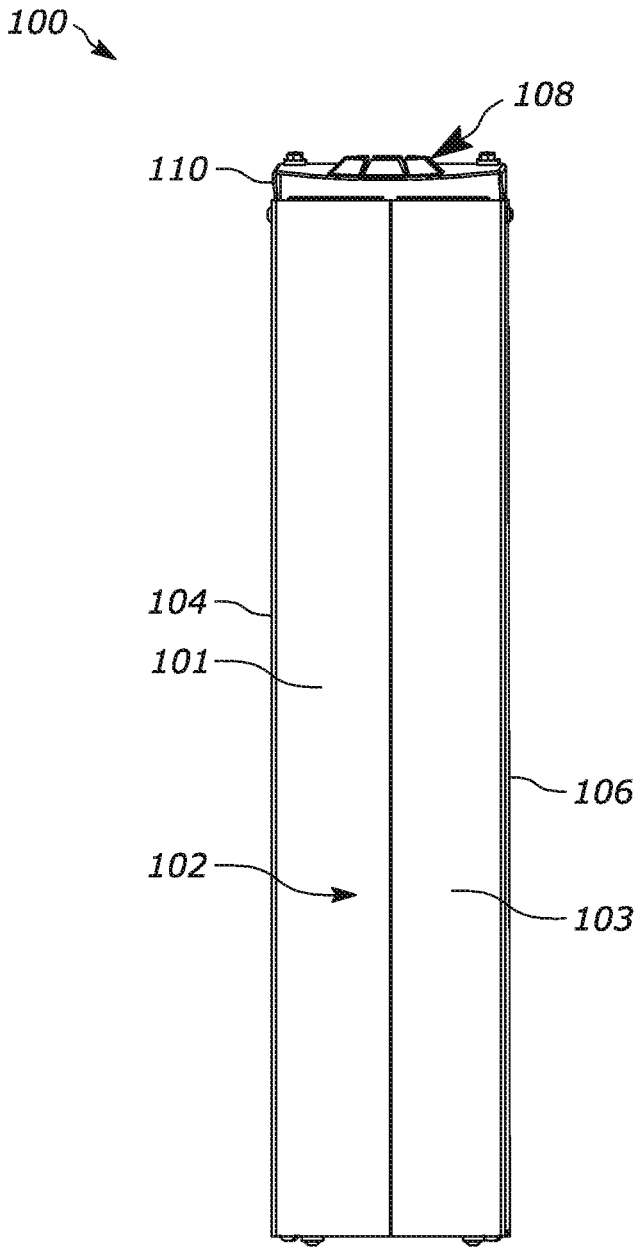
FIG. 6 is a top view of a packing material dispenser in accordance with various embodiments.
Figure 7:
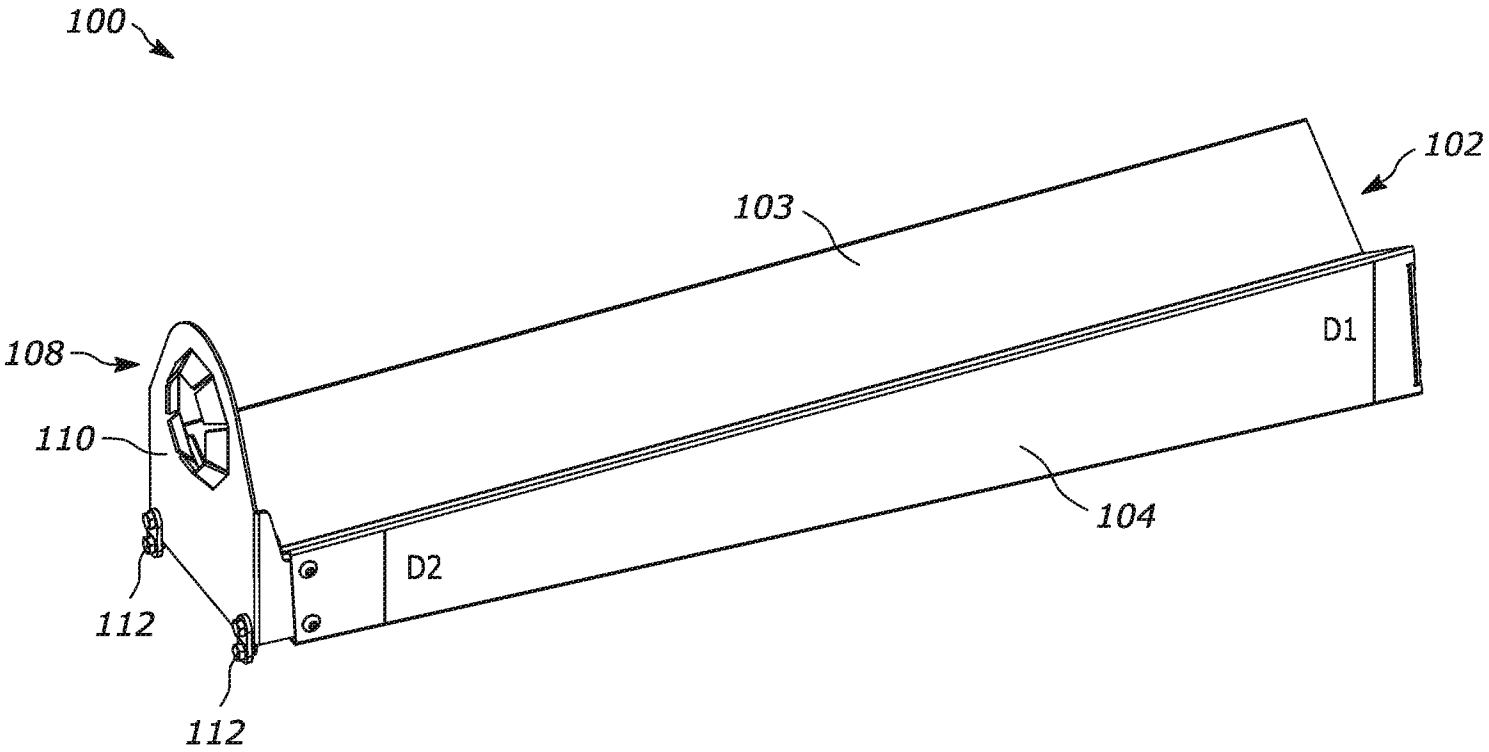
FIG. 7 is a perspective view of a packaging material holder in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments. Also, common but well-understood elements that are useful or necessary in a commercially feasible embodiment are often not depicted to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Described herein are apparatuses that are useful for dispensing, holding, and/or storing packing material. Such apparatuses also may assist with organization of packing materials, including, such as, rolls of kraft paper used as packing materials.

Whereas storing packing materials in one location, such as a designated room, building, and/or warehouse, may cause delays in packing and/or packaging items, products, boxes, and the like, in instances where the items are stored in a different area than the packaging materials, these teachings may help avoid those delays. This may provide for an additional roll of packing material near the location of packaging. Further, by interconnecting the rolls of packing material, the time to change rolls of packing material when the first roll ends is substantially seamless, saving time and money. By providing a packing material dispenser including storage and dispensing of multiple rolls of packing material, delays in packaging can be shortened.

Generally speaking, pursuant to these various embodiments described herein, a packing material dispenser includes a face plate including a spout, a chute including side walls, and rails to hold the rolls of packing material. In one illustrative approach, the packing material dispenser includes a face plate including a spout, first side walls connected to the face plate, an angled chute or channel defined by a first side and a second side, and rails on each side. So configured, the face plate provides a location for packing material to be pulled from the center of the roll of packing material.

By interconnecting the first roll of packing material and a second roll of packing material, time can be saved by seamlessly transitioning from the first roll to the second roll when the first roll runs out. Additionally, by providing a chute for the rolls of packing material to be deposited in, the rolls of packing material may be substantially parallel, or in-line, with one another. This allows for the material to be pulled through the face plate and spout seamlessly without readjusting the rolls of packing material after the first roll runs out.

In one exemplary embodiment, the packing material dispenser may include an angled chute for the rolls of packing material to be biased towards the face plate and spout. The angle of the chute is of particular note due to the need for the forward bias of the rolls of packing material without the overbiasing of the rolls into the face plate. If the angle of the chute is too shallow, i.e., substantially parallel to the surface the packing material dispenser is placed on, the rolls of packing material will not be biased towards the face plate and may result in a user applying an increased amount of force on an end of the packing material and potentially ripping the end of the packing material. Conversely, if the chute is angled such that it is too steep, i.e., the angle relative to the surface the packing material is placed on is too large, the rolls of packing material may be overbiased (by gravity) such that the rolls of packing material bind on the back side of the base plate. Similar to the chute being too shallow, a user applying an increased amount of force on an end of the packing material and potentially ripping the end of the packing material. As a result, in some embodiments, an optimized angle of the chute may be needed to properly bias the rolls of packing material towards the face plate and spout to avoid a user ripping an end thereof. Similarly, in some configurations, the packing material dispenser may include rails in addition to or in place of the chute. In these configurations, the rails may be disposed such that a downward slope is created to aid in advancing the rolls of material towards the face plate and spout.

In some configurations, the packing material dispenser may include angled sides of the chute. Similar to the angle of the chute itself, if the angle of the sides is too steep or too shallow, the side of the rolls of packing material may over contact the sides of the chute. As a result, the side of the chute may add additional friction to the sides of the rolls of packing material and may result in a user applying an increased amount of force on an end of the packing material and potentially ripping the end of the packing material. As a result, the angle of the sides may be optimized to provide sufficient contact between the sides of the chute and the rolls of packing material. Similarly, in some configurations, the packing material dispenser may include rails in addition to or in place of the angled sides. In these configurations, the rails may be angled such that sufficient contact between the rails and the rolls of packing material is achieved without adding too much additional friction.

In further configurations, bearings may be utilized to aid in the dispensing and advancing of the packing material and rolls thereof. The bearing may be used as an alternative or in addition to the downward slope of the packing material dispenser, via the chute, sides of the chute, or rails. The bearings may be disposed such that the direction of rotation of the bearings is substantially parallel to the sides of the chute and/or rails, i.e., the bearings rotate towards and away from the face plate and spout. In this way, not only do the bearings aid in advancing the rolls of packing material down towards the face plate and spout, when re-loading the packing material dispenser, a user can place a roll at the front of the packing material dispenser, near the face plate and spout, and slide the roll backwards to add another roll of packing material. This allows the packing material dispenser to be placed in more confined and/or covered locations, such as on a shelf where a user may not typically be able to reach the rear of the packing material dispenser.

Referring now to the drawings, wherein identical numerals indicate the same elements throughout the figures, FIGS. 1 to 7 illustrate an example packing material dispenser 100 in accord with some embodiments. The packing material dispenser 100 includes a face plate 110 including a spout 108, a first side wall 104 coupled to the face plate 110, a second side wall 106 coupled to the face plate 110, and a rear plate 107 coupled to the first side wall 104 and the second side wall 106. The packing material dispenser 100 and corresponding elements may be metal, plastic, carbon fiber, or another material strong enough to support the weight of at least one roll of packaging material, e.g., a first roll 118 and a second roll 120. Additional rolls may be included if the dispenser's 100 length sufficiently supports the rolls.

The face plate 110 may be substantially perpendicular to the first side wall 104 and the second side wall 106. In one embodiment, a first angled wall 101 and a second angled wall 103 define a chute 102. The chute 102 may be angled downward from the rear plate 107 to the face plate 110, as illustrated by D1 and D2 in FIG. 2. D1 is the height of the packing material dispenser 100 at the rear of the dispenser, and D2 is the height of the packing material dispenser 100 at the front of the dispenser. As shown, D1 is larger than D2 providing the downward slope of the chute 102 towards the face plate 110. This provides sufficient biasing of the rolls of packing material to slide down the chute and contact the face plate 110. In one embodiment, the first side wall 104 and the second side wall 106 define the chute's 102 sides. As noted above, the angle, or slope of the chute 102, adjusted via changing D1 and D2 may be needed to optimize the amount of downward force applied to the rolls of packing material via gravity. This angle may be between 2 and 20 degrees relative to horizontal. In one illustrative embodiment, the angle is approximately 5 degrees relative to horizontal.

The spout 108 may have a conical shape, and in some configurations, the spout 108 may have a frustoconical shape. The spout 108 may include protrusions and slots along the spout 108 to provide locations to tear or rip the packing material when used. The protrusions may make a substantially octagonal shape with the slots at each corner providing eight different locations and orientations for the packing material to be torn. The face plate 110 is coupled to at least the first side wall 104 and the second side wall 106. The face plate 110 may also be coupled to the first angled wall 101 and the second angled wall 103. In some configurations, the protrusions or slots may include a sharpened end to aid in ripping or tearing the packing material. This allows a user to pull the packing material through the spout 108 and tear the packing material at various, or all, angles. As a result, the location the packing material dispenser 100 is placed can be optimized to allow several users to use the packing material dispenser 100 at once.

The face plate 110 may additionally include, or be coupled to, feet 112. The feet 112 can be used to bolt the packing material dispenser 100 to a shelf or benchtop in order to secure the packing material dispenser 100 in place. Similarly, the packing material dispenser 100, particularly the rear plate 107, may include stops 114 coupled to the rear of the packing material dispenser 100. The stops 114, similar to the feet 112, can be used to bolt the packing material dispenser 100 to a shelf or benchtop in order to secure the packing material dispenser 100 in place. The spout 108 and at least one of the feet 112 or the stops 114 allows for the one-handed operation of the packing material dispenser 100.

In some embodiments, the chute 102 may be substantially above the surface the packing material dispenser 100 is placed on. In other embodiments, the chute 102 may be just above the surface on which the packing material dispenser 100 is placed, as shown and discussed below with reference to FIG. 8. By providing a packing material dispenser 100 including multiple rolls of packing material in line with one another and linked together, space for dispensing the packing material can be saved and maximized.

Figure 8:
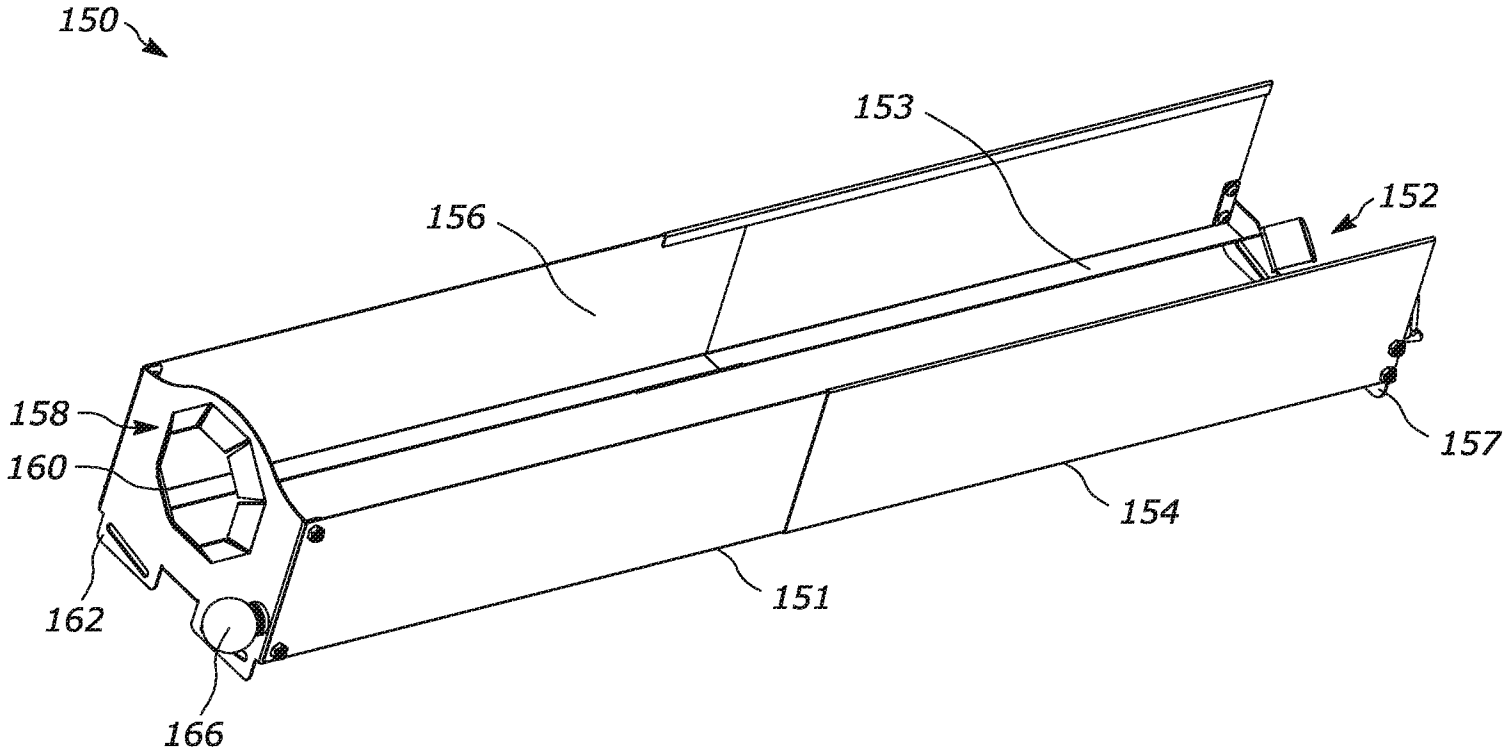
FIG. 8 is a perspective view of a packing material dispenser in accordance with various embodiments.
Figure 9:
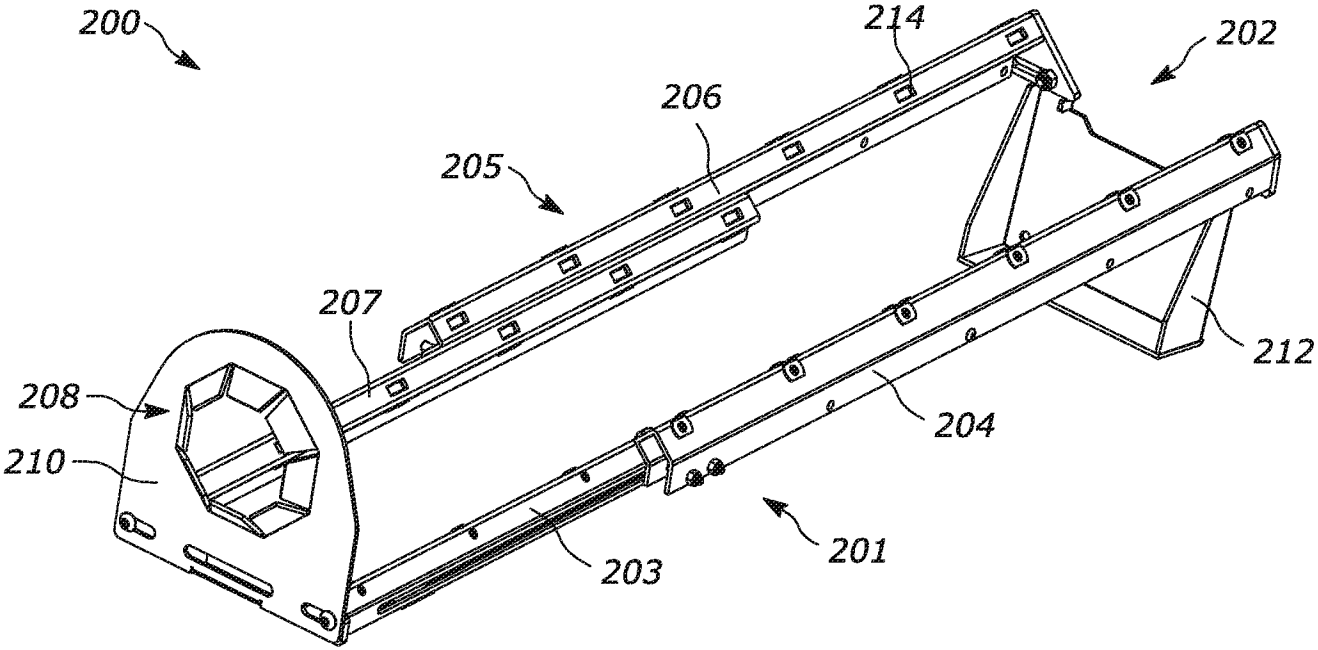
FIG. 9 is a perspective view of a packing material dispenser in accordance with various embodiments.

Referring to FIG. 8, a packing material dispenser 150 is shown. The packing material dispenser 150 is similar to the packing material dispenser 100. The packing material dispenser 150 includes a face plate 160, a spout 158, a first side wall 154, a second side wall 156, a chute 152, and a handle 166. The face plate 160 is similar to the face plate 110. Similarly, the spout 158 is similar to the spout 108. The first side wall 154 and the second side wall 156 are similar to the first side wall 104 and the second side wall 106. The face plate 160 includes attachment points 162, similar to the feet 112.

The packing material dispenser 150 includes a rear plate 157. The rear plate 157 provides a downward angle, or decline, of the packing material dispenser 150, and in particular the rear plate 157. The chute 152 is defined between the first side wall 154 and the second side wall 156. The first side wall 154 and the second side wall 156 may include a first angled portion 151 (not shown) and a second angled portion 153 to keep the rolls of packing material displaced therein off the surface the packing material dispenser 150 is rested on.

The handle 166 includes a rod extending from the face plate 160 towards the rear plate 157 and is slidably attached to the first angled portion 151. The handle 166 may be used to move rolls of packing material forward while in use or after use. This allows for a minimal decline of the chute 152 (for example between zero and 10 degrees) while providing a way to advance the rolls of packing material forward towards the face plate 160. The handle 166 is similar to the handle 316 and corresponding elements described in more detail below, with reference to FIGS. 16 and 17.

Referring to FIGS. 9-15, another example packing material dispenser 200 is shown. The packing material dispenser 200 includes a face plate 210 having a spout 208, a first telescoping rail 201, a second telescoping rail 205, bearings 214, and a rear stand 212. The first telescoping rail 201 includes rails 203 and 204. Similarly, the second telescoping rail 205 includes rails 206 and 207. While illustrated having two rails each, the first telescoping rail 201 and the second telescoping rail 205 may include a plurality of rails on each side to provide additional length, and in turn, additional storage for rolls of packing material. So configured, the packing material dispenser 200 may be adjusted in length to match a length needed to support one, two, three, or more rolls of packing material.

Figure 10:
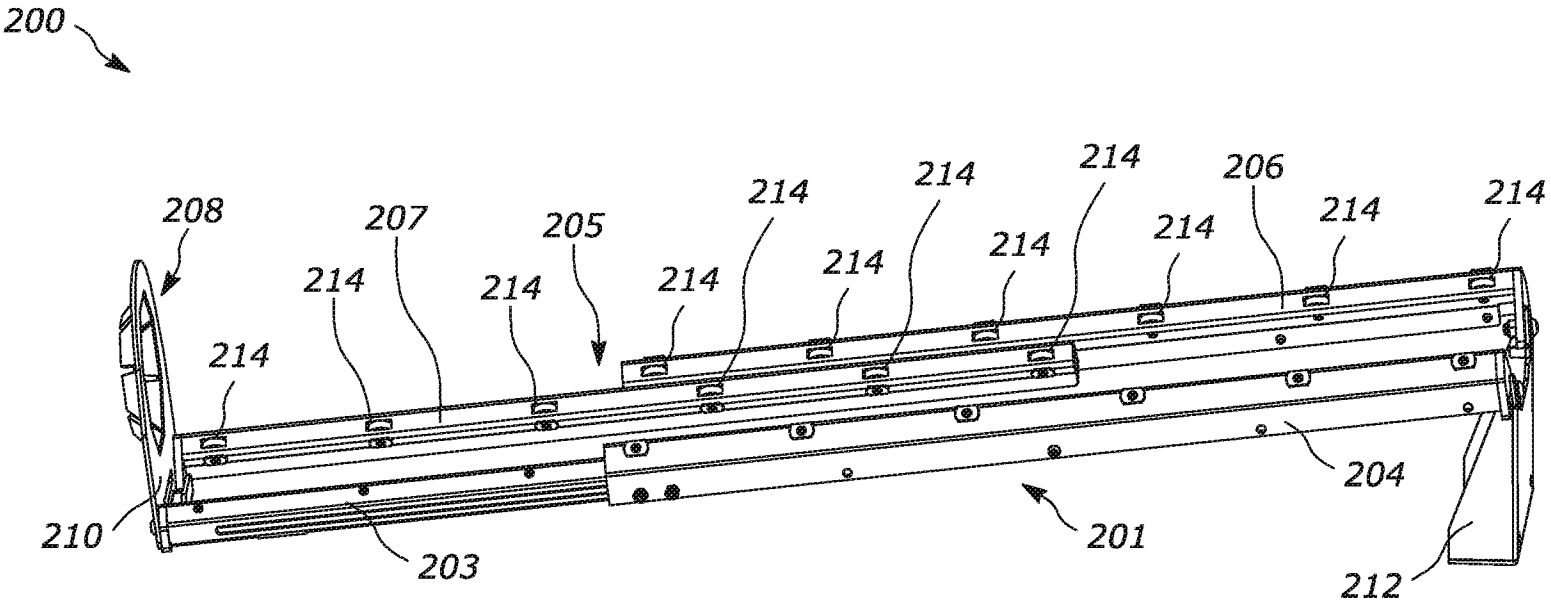
FIG. 10 is a side view of a packing material dispenser in accordance with various embodiments.
Figure 11:
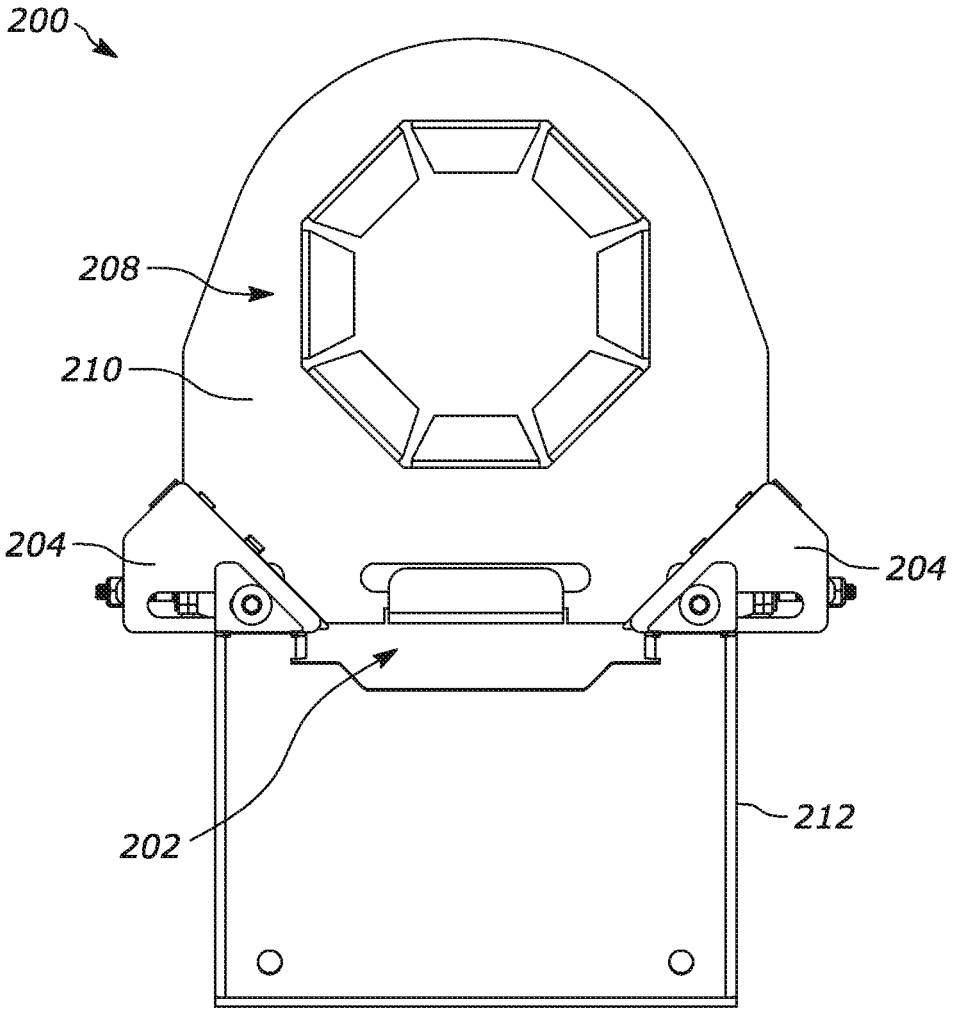
FIG. 11 is a rear view of a packing material dispenser in accordance with various embodiments.
Figure 12:
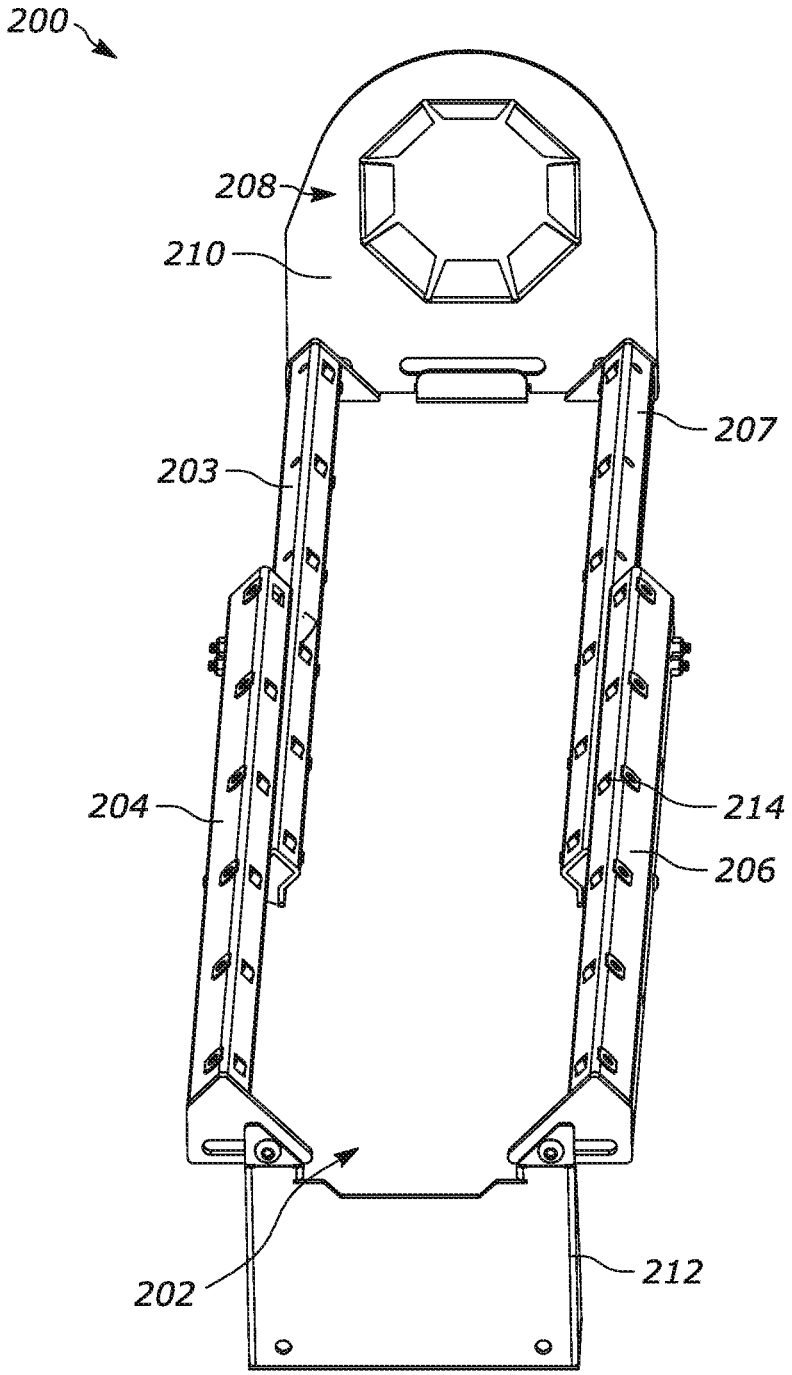
FIG. 12 is a top perspective view of a packing material dispenser in accordance with various embodiments.
Figure 13:
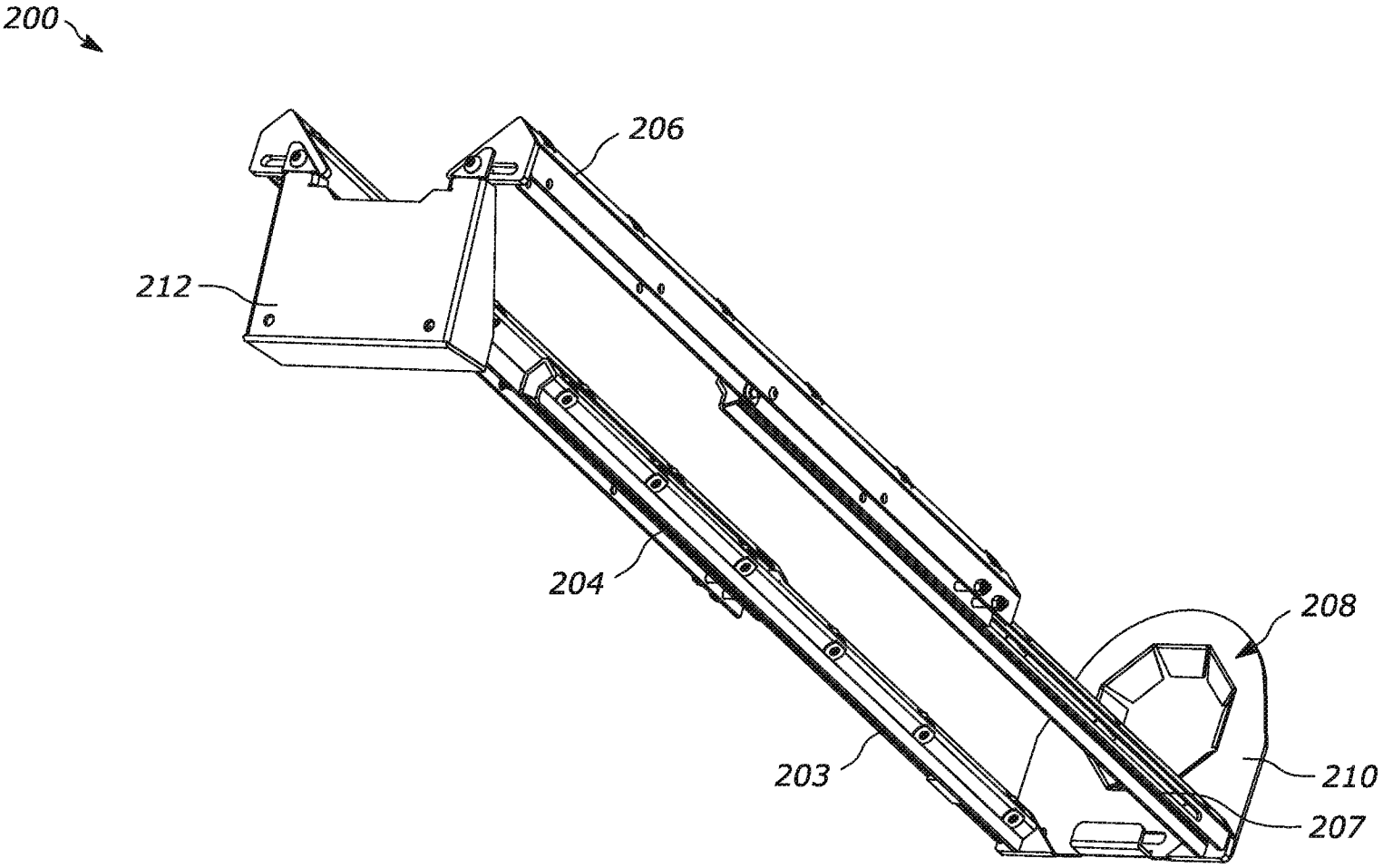
FIG. 13 is a bottom perspective view of a packing material dispenser in accordance with various embodiments.
Figure 14:
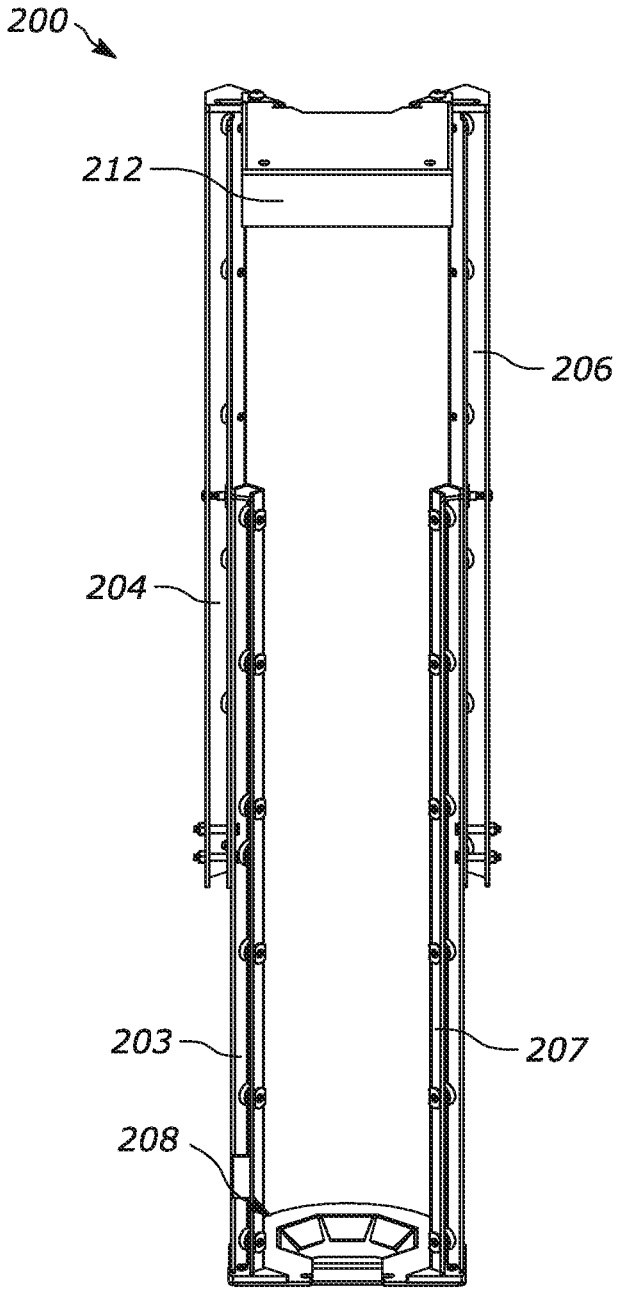
FIG. 14 is a bottom view of a packing material dispenser in accordance with various embodiments.
Figure 15:
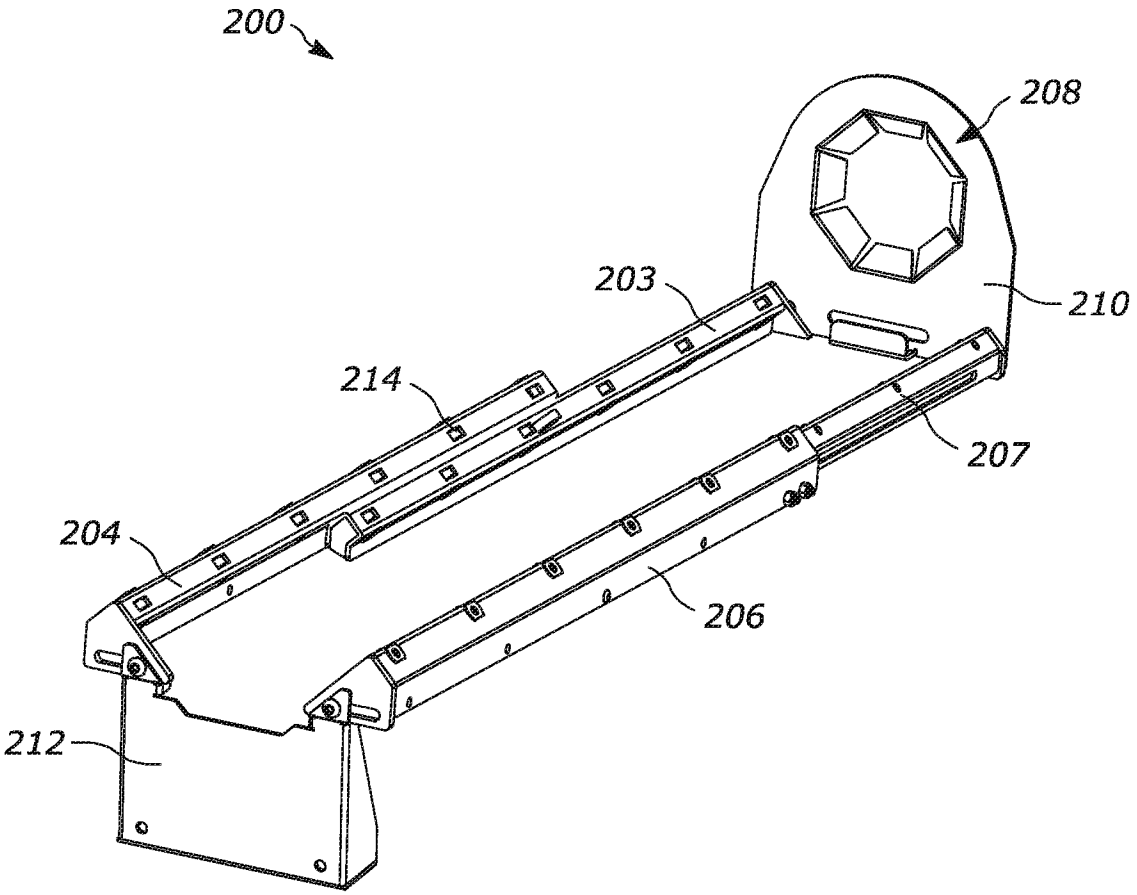
FIG. 15 is a rear perspective view of a packing material dispenser in accordance with various embodiments.

As shown in FIG. 10, the first telescoping rail 201 and the second telescoping rail 205 include a plurality of bearings 214, or rollers. The bearings 214 aid in biasing the rolls of packing material towards the face plate 210 and spout 208. Additionally, the rear stand 212 aids in raising the rear of the packing material dispenser 200 to provide an additional biasing force, i.e., gravity, to bias the rolls of packing material towards the face plate 210 and spout 208. The face plate 210 and the spout 208 are similar to the face plate 110 and the spout 108. The rear stand 212 may include openings which can be used to bolt the packing material dispenser 100 to a shelf or benchtop in order to secure the packing material dispenser 100 in place.

Figure 16:
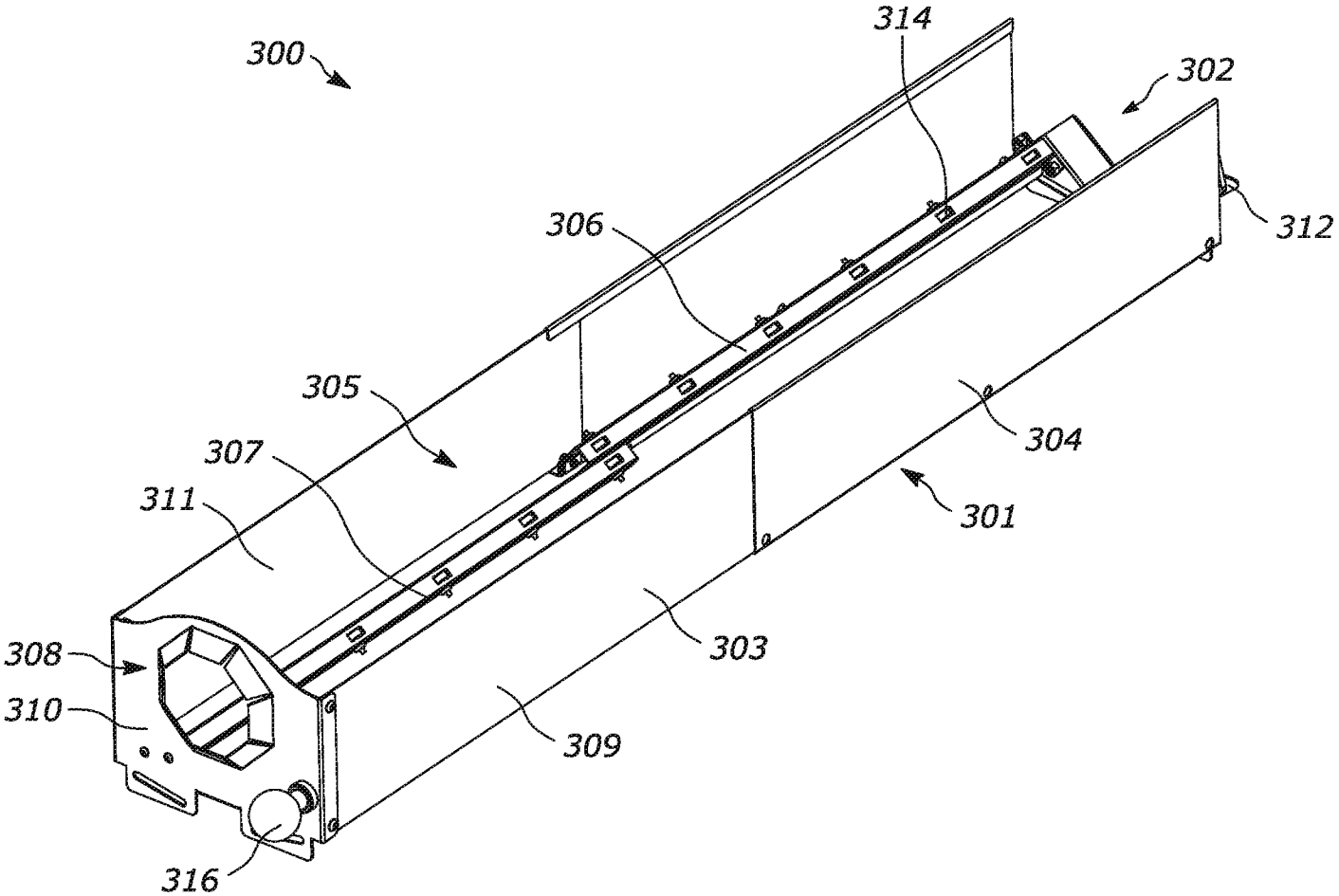
FIG. 16 is a perspective view of a packing material dispenser in accordance with various embodiments.
Figure 17:
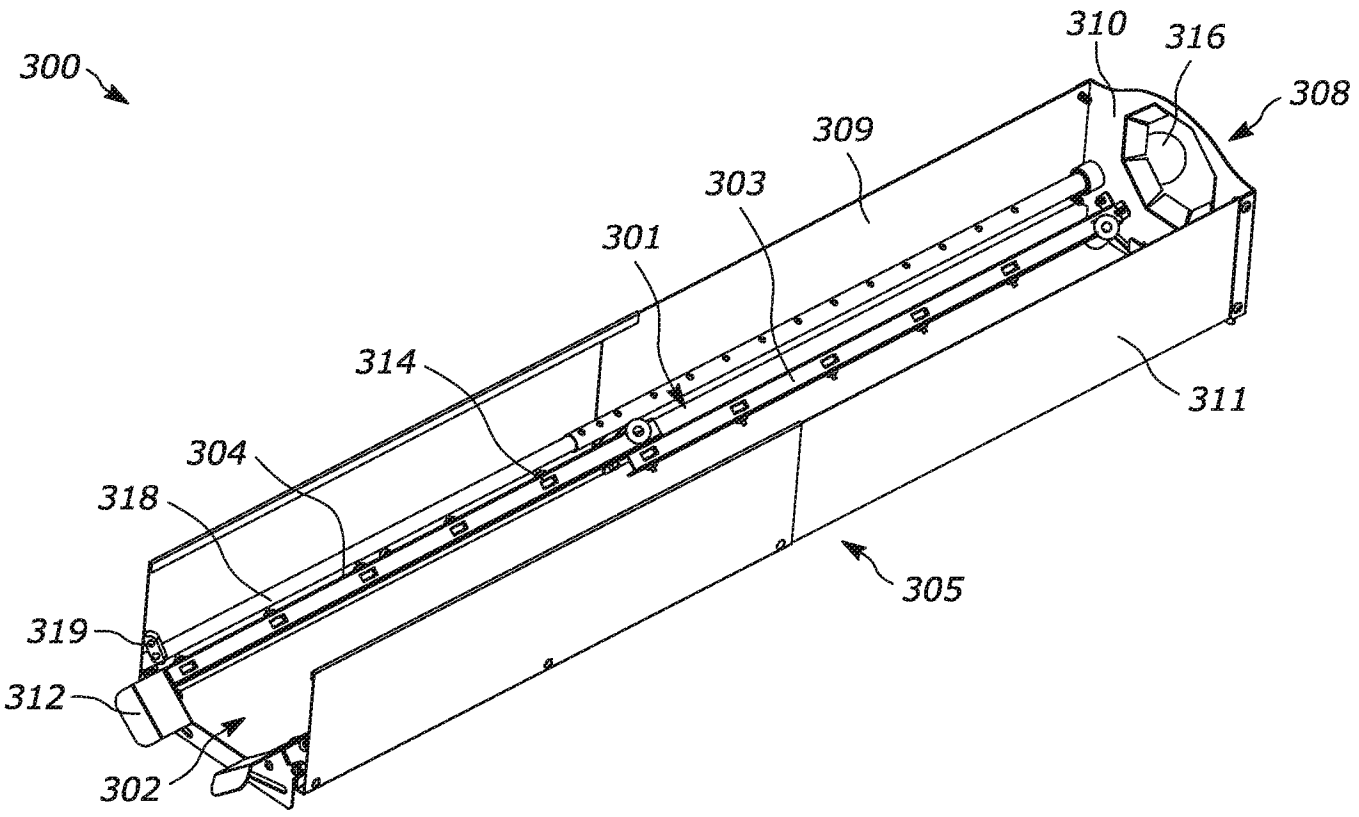
FIG. 17 is a rear perspective view of a packing material dispenser in accordance with various embodiments.

Referring to FIGS. 16 and 17, a packing material dispenser 300 is shown. The packing material dispenser 300 includes a face plate 310 having a spout 308, a first side wall 309, a second side wall 311, a first telescoping rail 301, a second telescoping rail 305, bearings 314, a rear stand 312, a chute 302, and a handle 316. The first telescoping rail 301 includes rails 303 and 304. Similarly, the second telescoping rail 305 includes rails 306 and 307. The face plate 310, the spout 308, the bearings 314, the chute 302, and the rear stand 312 are similar to those described above. The rails 303 and 304 are positioned such that the rail 303, disposed closer to the face plate 310 and spout 308, is positioned below the rail 304. Similarly, the rails 307 and 306 are positioned such that the rail 307 disposed closer to the face plate 310 and spout 308 is positioned below the rail 306. In this way, a downward slope may be achieved such that the rolls of packing material are biased downward towards the face plate 310 and the spout 308. This downward biasing may be utilized in addition to or in place of the bearings 314. When used with the bearings 314, the downward slope aids in the optimization of the dispensing of the packing material.

The first side wall 309 and the second side wall 311 may include, similar to the first telescoping rail 301 and the second telescoping rail 305, telescoping panels. While illustrated having two rails and panels each, the first telescoping rail 301, the second telescoping rail 305, the first side wall 309, and the second side wall 311 may include a plurality of rails and panels on each side to provide additional length, and in turn, additional storage for rolls of packing material.

The handle 316 includes a rod 318 extending from the face plate 310 towards the rear stand 312 and is slidably attached to at least one of the first side wall 309, the first telescoping rail 301, the rails 303 and/or 305. The handle 316 may be used to pull the rod 318 to move rolls of packing material forward while in use or after use. The handle 316 and the rod 318 include a protruding end 319 configured to reach behind the rolls of packing material. The handle 316 is rotatable such that the rod 318 and protruding end 319 can be rotated to engage and disengage rolls of packing material disposed in the packing material dispenser 300. This allows for a minimal decline of the chute 302 while providing a way to advance the rolls of packing material forward towards the face plate 310.

In use, at least a first roll of packing material and a second roll of packing material is deposited into a packing material dispenser. The first roll of packing material and the second roll of packing material are substantially parallel relative to one another or in line with each other. The rolls of packing material may come interconnected, if not, the first roll of packing material and the second roll of packing material are interconnected. For instance, the last portion of the first roll's material (such as paper) may be connected to the first portion of the second roll's material, such as by tape or other connecting material. Once interconnected, a portion of packing material is pulled through a spout of the packing material dispenser. The portion of the packing material pulled from the packing material dispenser is torn to be placed inside of a package. When the last portion of the first roll's packing material is pulled through the material dispenser, because it is attached to the second roll's packing material, the second roll's packing material immediately pulls through the material dispenser, reducing the time needed to reset the dispenser with new material.

The terms and expressions used herein have the ordinary technical meaning as is accorded to such terms and expressions by persons skilled in the technical field as set forth above except where different specific meanings have otherwise been set forth herein. The word "or" when used herein shall be interpreted as having a disjunctive construction rather than a conjunctive construction unless otherwise specifically indicated. The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin.

What is claimed:

1. A dispenser comprising:

a face plate including a spout having a conical shape;

a first side wall and a second side wall connected to the face plate and defining a chute therebetween;

a first rail and a second rail disposed within the chute and connected to the face plate and configured to support at least one roll of packing material; and rollers disposed on the first rail and the second rail.

2. The dispenser of claim 1 wherein the first rail and the second rail are telescoping and include at least two nested rail segments.

3. The dispenser of claim 1 wherein the chute is sized to fit at least one roll of packing material.

4. The dispenser of claim 1 wherein the chute is sized to fit at least two rolls of packing material.

5. The dispenser of claim 1 wherein the spout extends from the face plate.

6. The dispenser of claim 1 wherein the spout is shaped to allow packing material to be pulled therethrough.

7. The dispenser of claim 1 further comprising a plurality of rollers disposed on the first rail and the second rail to aid in rotation of at least one roll of packing material.

8. The dispenser of claim 1 further comprising a rear stand connected to the first rail and the second rail and configure to provide a decline to bias at least one roll of packing material towards the face plate and the spout.

9. A method comprising:

depositing at least a first roll of packing material and a second roll of packing material into a packing material dispenser, the packing material dispenser including:

a face plate including a spout having a conical shape;

a first side wall and a second side wall connected to the face plate and defining a chute therebetween;

a first rail and a second rail disposed within the chute and connected to the face plate and configured to support at least the first roll of packing material; and rollers disposed on the first rail and the second rail;

wherein the first roll of packing material and the second roll of packing material are substantially parallel relative to one another;

interconnecting the first roll of packing material and the second roll of packing material;

pulling a portion of packing material through the spout of the packing material dispenser; and tearing the portion of the packing material from the packing material dispenser to be placed inside of a package.

10. The method of claim 9 further comprising:

pulling a final portion of packing material of the first roll through the spout of the packing material dispenser, which pulls a first portion of packing material of the second roll through the spout.

* * * * *